US010280478B2

(12) United States Patent
Stillger

(10) Patent No.: US 10,280,478 B2
(45) Date of Patent: May 7, 2019

(54) PRODUCTION LINE AND TOOL ARRANGEMENT FOR PRODUCING A HOT FORMED COMPONENT FROM A BLANK

(71) Applicant: GM GLOBAL TECHNOLOGY OPERATIONS LLC, Detroit, MI (US)

(72) Inventor: Martin Stillger, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 155 days.

(21) Appl. No.: 15/383,823

(22) Filed: Dec. 19, 2016

(65) Prior Publication Data

US 2017/0175222 A1 Jun. 22, 2017

(30) Foreign Application Priority Data

Dec. 18, 2015 (DE) ..... 10 2015 016 532

(51) Int. Cl.

| | |
|---|---|
| ***C21D 9/56*** | (2006.01) |
| ***C21D 9/00*** | (2006.01) |
| ***C21D 8/02*** | (2006.01) |
| ***C21D 1/18*** | (2006.01) |
| ***B21D 22/02*** | (2006.01) |
| ***B21D 37/08*** | (2006.01) |
| ***B21D 37/16*** | (2006.01) |

(52) U.S. Cl.

CPC ..... *C21D 9/562* (2013.01); *B21D 22/022* (2013.01); *B21D 37/08* (2013.01); *B21D 37/16* (2013.01); *C21D 1/18* (2013.01); *C21D 8/0221* (2013.01); *C21D 8/0247* (2013.01); *C21D 9/0056* (2013.01); *C21D 9/561* (2013.01)

(58) Field of Classification Search

CPC ..... C21D 9/562; C21D 9/561

See application file for complete search history.

(56) References Cited

U.S. PATENT DOCUMENTS

| | | | | |
|---|---|---|---|---|
| 7,254,977 | B2 | 8/2007 | Machrowicz et al. | |
| 8,127,449 | B2 | 3/2012 | Bayer et al. | |
| 8,733,144 | B2 | 5/2014 | Pohl et al. | |
| 8,919,164 | B2 | 12/2014 | Shulkin et al. | |
| 9,308,564 | B2 * | 4/2016 | Potocki | C21D 9/005 |
| 2007/0175040 | A1 * | 8/2007 | Bayer | B21D 35/00 29/897.2 |
| 2014/0124104 | A1 | 5/2014 | Trippe et al. | |

FOREIGN PATENT DOCUMENTS

| | | | |
|---|---|---|---|
| DE | 102012021031 | A1 | 5/2013 |
| DE | 102012000189 | A1 | 7/2013 |
| DE | 102012112334 | A1 | 6/2014 |

OTHER PUBLICATIONS

German Patent Office, German Search Report for German Application No. 1020150165321, dated Jul. 25, 2016.

* cited by examiner

*Primary Examiner* — Scott R Kastler
(74) *Attorney, Agent, or Firm* — Lorenz & Kopf, LLP

(57) ABSTRACT

A tool arrangement is disclosed for integration in a production line for producing a hot formed component from a blank which is produced from a hot forming steel strip. The tool arrangement includes a housing, which delimits an interior of the tool arrangement relative to a surroundings of the tool arrangement, a tempering station for tempering the blank and a hot forming station for hot forming the blank. The tempering station and the hot forming station are jointly arranged in the interior.

14 Claims, 3 Drawing Sheets

PRODUCTION LINE AND TOOL ARRANGEMENT FOR PRODUCING A HOT FORMED COMPONENT FROM A BLANK

CROSS-REFERENCE TO RELATED APPLICATION

This application claims priority to German Patent Application No. 102015016532.1, filed Dec. 18, 2015, which is incorporated herein by reference in its entirety.

TECHNICAL FIELD

The present disclosure pertains to a tool arrangement for integration in a production line for producing a hot formed component from a blank, and more particularly a blank which is produced from a hot forming steel strip.

BACKGROUND

Production lines, in which blanks are hot formed and subsequently press hardened to produce hot formed components therefrom are generally known from the prior art. For example, the patent publication DE10 2012 110 649 B3 describes a hot forming line for producing a hot formed and press hardened steel sheet product. The hot forming line includes a tempering station for tempering a blank and a forming tool arranged spaced and separately from the same for hot forming the blank.

SUMMARY

The present disclosure provides a functionally improved tool arrangement for integration in a production line for producing a hot formed component from a blank. In particular, a tool arrangement, such as a progressive tool, is disclosed which is configured to integration in a production line. In the production line, a hot formed component can be produced from a blank, for example a steel alloy blank. The blank is a component which is cut from a hot forming steel strip. The hot forming steel strip includes the steel alloy. Preferably, the blank or the hot forming steel strip is formed from an uncoated steel alloy, for example from a boron manganese steel. Alternatively, the blank or the hot forming steel strip can include the steel alloy and have a metallic layer, e.g. consisting of aluminum or zinc. For example, the hot formed component formed from the blank is formed as a steel sheet component, for example vehicle a component such as a body component.

The tool arrangement includes a housing delimiting an interior of the tool arrangement relative to a surroundings of the tool arrangement. The housing surrounds the tool arrangement completely. In particular, the housing is closed during the production of the hot formed component. For introducing the hot forming steel strip and for removing the hot formed component from the tool arrangement the housing can be opened. Preferably, the housing has a first and a second lock for this purpose.

For example, the tool arrangement includes an upper tool and a lower tool which are configured by at least one tool stroke for producing the blank and/or the hot formed component. Preferably, the interior is formed between the upper tool and the lower tool. Here, the upper tool and the lower tool preferably form themselves a part of the housing. Optionally, the tool arrangement, in particular the housing, includes offsetting elements for offsetting the tool stroke and for hermetically sealing relative to the surroundings. In throughput direction, the tool arrangement is sealed off relative to the surroundings by a first and second lock.

The first lock can preferably be embodied before the cutting station and the second lock preferably after the forming station, in particular after the separating device. However, a position of the locks within the tool arrangement is also possible, wherein preferably the last stage of the tempering station, the hot forming station and the hardening device should be located between the two locks in the interior.

The tool arrangement includes a tempering station which is configured to tempering the blank. Preferably, the tempering station is configured to heat the blank at least in some sections to at least 400° C., in particular to at least 700° C., specifically to at least 900° C. and/or to 1,100° C.

The tool arrangement includes a hot forming station which is configured to hot forming the blank. For example, the hot forming station is designed as a hot forming press. The tempering station and the hot forming station are jointly arranged in the interior of the tool arrangement. Preferably, the hot forming station is arranged downstream of the tempering station in the interior. In particular, the tempering station and the hot forming station are completely surrounded by the housing of the tool arrangement.

It is advantageous that a heat loss of the blank, which usually occurs during the transport from the tempering station to the hot forming station, can be diminished and/or largely avoided by the joint arrangement in the interior of the tool arrangement. In particular, for thin blanks with a material thickness of less than 1.0 mm this is particularly advantageous since these cool down more quickly than blanks with a greater material thickness. It is advantageous, furthermore, that by avoiding the rapid cooling down of the blanks energy saving of at least 30% compared with conventional tool arrangements without housing can be achieved. Because of this, energy costs for producing the hot formed component and resources can be saved in production.

A preferred configuration of the present disclosure provides that the interior of the tool arrangement can be shielded air-tight relative to the surroundings of the tool arrangement. In particular, the interior can be shielded air-tight relative to the surroundings by the housing. It is also possible within the scope of the present disclosure that the tool arrangement includes a protective gas device which is configured to generating a protective gas atmosphere in the interior of the tool arrangement. For example, the protective gas atmosphere can be formed by the housing. Because of this, scaling on the blank in particular during a transport between the stations can be avoided. Furthermore, expensive coatings of the blank for avoiding the scaling can be omitted.

In a preferred embodiment of the present disclosure, the tempering station and the hot forming station are connected to one another via a transport belt of the tool arrangement. Preferably, the transport belt is configured to transport the blank from the tempering station into the hot forming station. In particular, a transport path, which is covered by the transport belt while transporting the blank between the tempering station and the hot forming station, is exclusively arranged in the interior of the tool arrangement. Specifically, no contact of the blank with the environment takes place during the transport between the two stations. Because of this, a temperature of the interior and of the blank can be largely kept constant. A loss of heat energy during the transport of the blank can be significantly reduced.

A preferred implementation of the present disclosure provides that the transport belt is formed from the hot forming steel strip. In particular, the hot forming steel strip as the transport belt is produced so that the blank remains connected with the transport belt so created by way of blank connections, e.g. webs or loops, which were likewise produced from the hot forming steel strip. It is also possible within the scope of the present disclosure that the transport belt is designed as a conveyor belt or a chain belt.

In a preferred configuration of the present disclosure, the hot forming station includes a hardening device. In particular, the hardening device is integrated in the hot forming station. Specifically, the hardening device is arranged in the interior of the tool arrangement. Preferably, the hardening device is configured to cool the hot formed component formed from the blank so that the desired material properties are created. Through different cooling conditions within the hardening device it is also possible, in addition to fully hardened hot formed components, to produce such components which are at least in one region, are part-hardened to have a different strength level with preferably higher ductility. Optionally complementarily, the hardening device includes for example a cooling device for cooling the hot formed component to a temperature which almost corresponds to an ambient temperature of the surroundings or is equal to the same.

In a preferred implementation of the present disclosure, the tempering station includes a heat source which is configured to tempering, in particular heating the blank. Preferably, the heat source is designed as an inductive heat source, as a resistive heat source or as a contacting heat source. It is also possible within the scope of the present disclosure that the tempering station is configured to heating at least one section of the blank and simultaneously for cooling at least one other section of the blank. In addition to the heat source, the tempering station can also include a cold source for cooling the section, for example a channel filled with coolant.

Alternatively or optionally complementarily, the tempering station can be configured to heat at least one first section of the blank to a first temperature and to heat at least one second section of the blank to a second temperature. In particular, this serves to achieve different structures and/or crystal states such as ferrite, austenite or pearlite, etc. in the respective sections of the blank to thereby form sections of different hardness in the hot formed component later on. For heating the second section to the second temperature, the tempering station preferably includes at least one insulated heat transfer region, so that the originally available heat energy in this region cannot be completely transferred to the blank. Alternatively or optionally complementarily, the second heat transfer region can be arranged spaced from the second section of the blank and thus transfer the lower heat energy to the second section. Preferably, the tempering station for heating the first section includes at least one first heat transfer region, which completely contacts the first section of the blank thus can transfer the heat energy available in this region to the blank completely.

Alternatively, the tempering station can also include multiple stages, which tempering station distributes the necessary heating for creating the required structures and/or crystal states over these stages to be able to correspondingly reduce the cycle times of the overall process.

In the tempering station, preferably only the region of the blank and if applicable also a region of the blank connection is heated in particular when the transport belt is formed as the hot forming steel strip. It is particularly preferred that the transport belt as the hot forming steel strip is not or hardly heated to eliminate heat distortion effects and/or to not disadvantageously influence the strength in the transport device by the input of heat.

Optionally, the tool arrangement includes a provisioning station, on which the hot forming steel strip is provided for further processing in the other stations. Preferably, the hot forming steel strip is wound up in the provisioning station as a roll, in particular as a so-called coil. For producing the blank from the hot forming steel strip, the same is gradually unwound and preferably fed to a cutting station for cutting the blank out of the hot forming steel strip. Preferably, the tool arrangement includes the cutting station, which is configured to cutting the blank out of the hot forming steel strip. In particular, the cutting station is designed in the interior of the tool arrangement. This has the advantage that because of the spatial proximity to the tempering station a transport path and/or a transport time can be reduced and because of this a cycle time for producing the hot formed component in the tool arrangement and/or in the production line can be produced.

Within the scope of the present disclosure it is possible, furthermore, that the tool arrangement includes a cold forming station for cold forming and/or re-cutting the blank. In particular, the cold forming station is configured to cold forming and/or for trimming the blank. Particularly preferably, the cold forming station is exclusively arranged in the interior of the tool arrangement. Preferably, the cold forming station is connected downstream of the cutting station in the interior of the tool arrangement and/or between the cutting station and the tempering station.

A further subject of the present disclosure relates to a production line with the tool arrangement according to the previous description. The production line includes the blank and preferably the hot forming steel strip.

In a preferred configuration of the present disclosure, the blank has a width which is directed in throughput direction when the blank is transported on the transport belt.

The transport path between the tempering station and the hot forming station has a length which corresponds to maximally twice the width of the blank, preferably maximally 1.5 times the width of the blank and in particular maximally the width of the blank. In particular when forming the transport device has the transport belt formed by the hot forming steel strip, the maximum transport path is preferably obtained from the width of the blank and the gap that is arranged on the transport belt between two blanks. Because of this transport path that is reduced to a minimum can be advantageously achieved so that the cooling of the blank during the transport between the tempering station and the hot forming station can be largely restricted.

It is preferred that the blank can be heated in the tempering stations in sections, in particular selectively or completely. This can be preferably effected by the already described heating of the blank in sections, for example through the various heat transfer regions of the tempering station.

In a preferred configuration of the present disclosure, the production line includes the hot formed component produced from the blank. Preferably, the blank has a charging state when the temperature station is charged with the blank. When the blank is output from the hot forming station as the hot formed component, the blank has an output condition.

In a preferred configuration of the present disclosure, the blank in the charging condition has a first component temperature which corresponds to and/or is equal to a surrounding temperature of the surroundings. In the output condition, the hot formed component has a second component temperature. It is particularly preferred that the second component temperature is elevated by a maximum of 50%, preferably by a maximum of 35%, specifically by a maximum of 20% of the first component temperature. In particular, the second component temperature is similar to and/or equal to the ambient temperature of the surroundings. This cooling down to almost the ambient temperature is achieved for example through the cooling device integrated in the hardening station. This has the advantage that the surroundings during and/or after the output of the hot formed component from the tool arrangement through the lock is not substantially heated. Accordingly it can be avoided that the ambient temperature of the surroundings rises to an unpleasantly high value. In addition, the hot formed component is easier and safer to handle when its temperature is approximately that of the ambient temperature.

A further subject of the present disclosure relates to a method for producing a hot formed component from a blank with a production line, preferably with the production line according to the previous description. The production line includes the blank and a tool arrangement, preferably the tool arrangement according to the previous description. The tool arrangement includes a housing which delimits the interior of the tool arrangement relative to the surroundings. The tool arrangement includes the tempering station, in which the blank is tempered. The tool arrangement includes the hot forming station in which the blank is formed. The tempering station and the hot forming station are jointly arranged in the interior.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
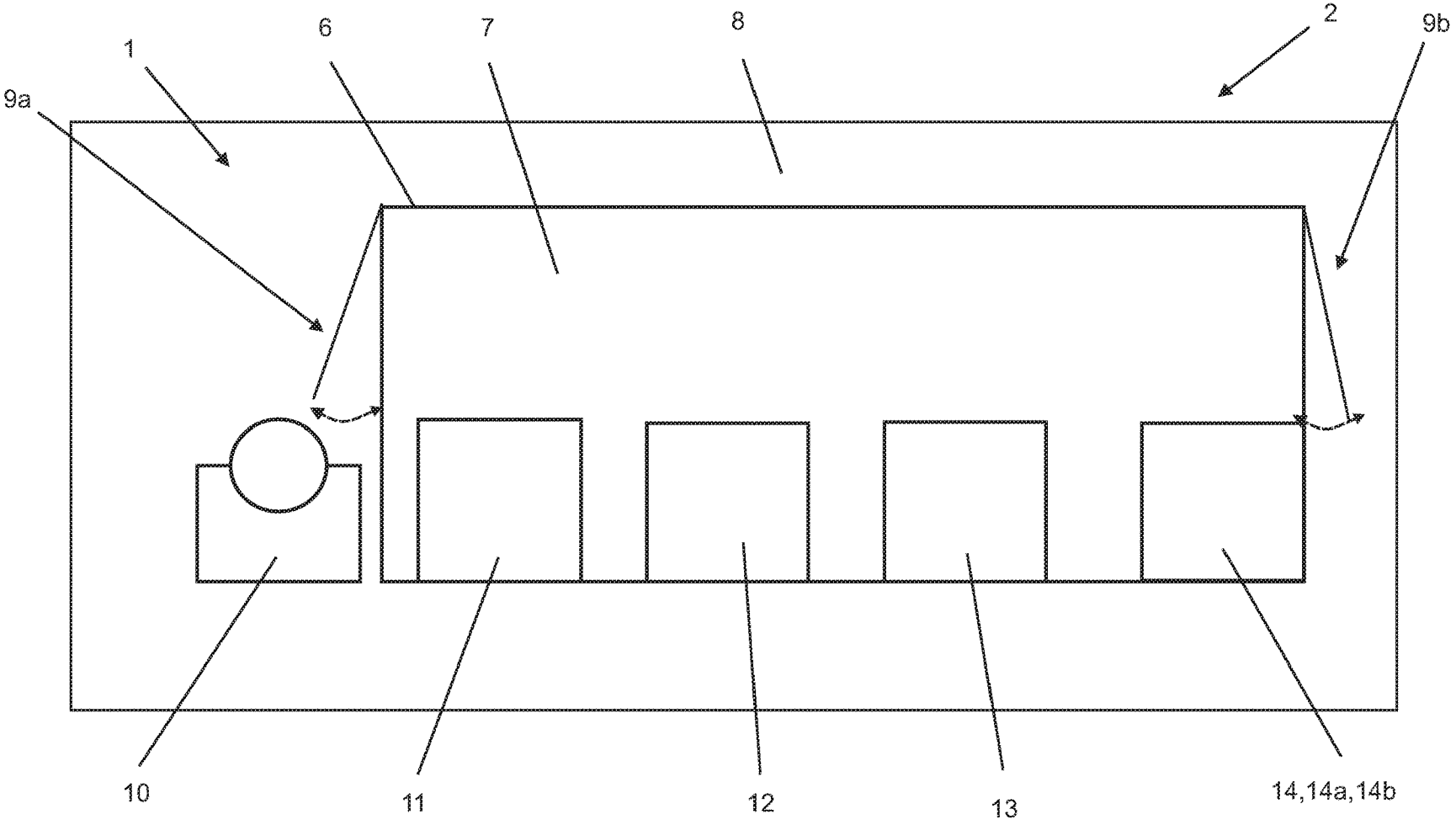
FIG. 1 shows a tool arrangement with multiple production stations for integration in a production line for producing a hot formed component from a blank, wherein the production stations are arranged in an interior of the tool arrangement.
Figure 2:
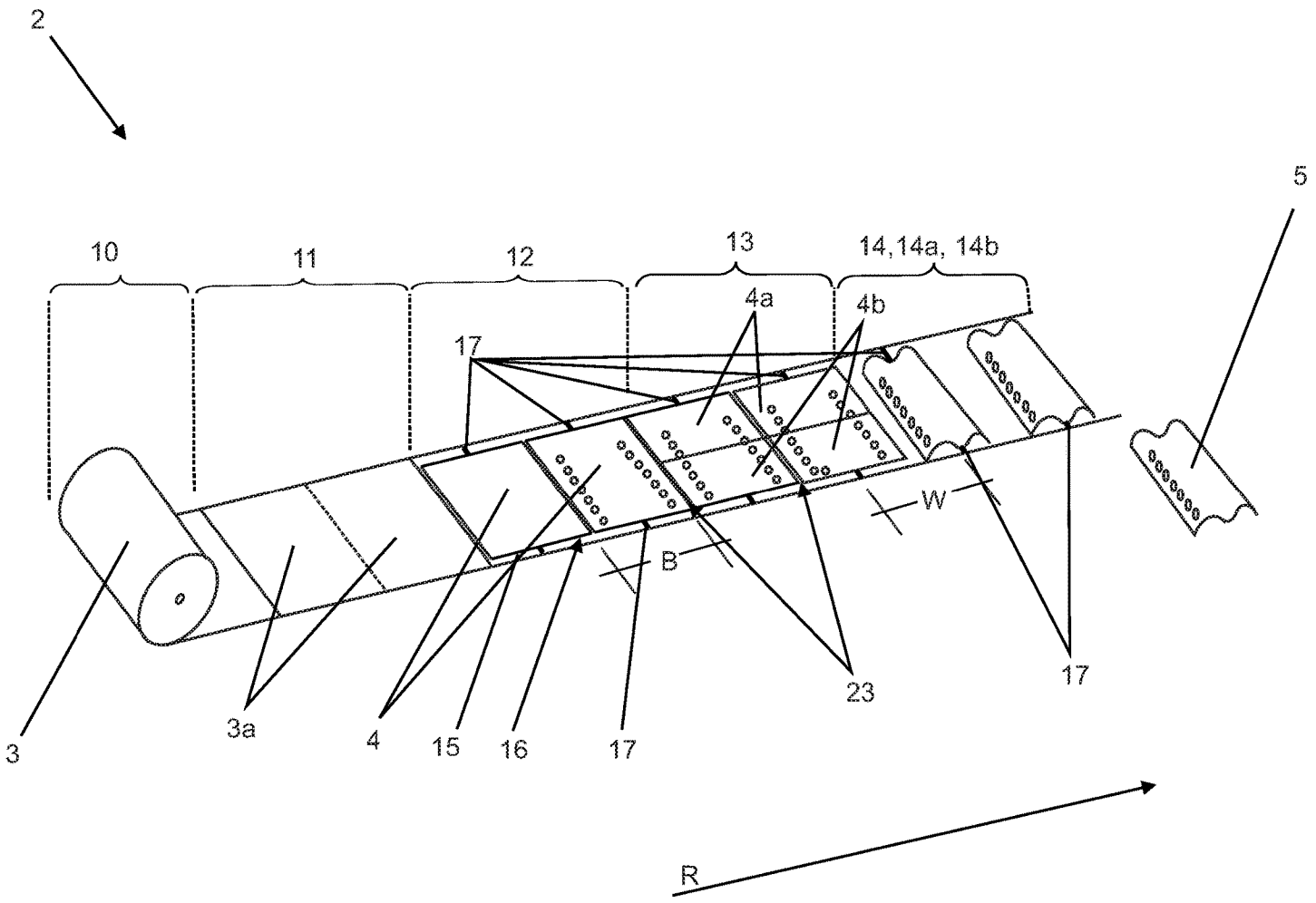
FIG. 2 shows the production line from FIG. 1, in which the hot formed component is produced from the blank, wherein the blank is previously cut out of a hot forming steel strip.

FIG. 1 shows a tool arrangement 1, which is configured to integration in a production line 2. The production line 2 is configured to producing a hot formed component 5 (FIG. 2) from a blank 4 (FIG. 2). The blank 4 is produced from a hot forming steel strip 3 (FIG. 2), in particular cut out of the hot forming steel strip 3. The blank 4 or the hot forming steel strip 3 are formed from an uncoated or coated steel alloy. The hot formed component 5 produced in the production line 2 is designed as a steel sheet component, for example vehicle component, in particular as a body component of a vehicle.

The tool arrangement 1 includes a housing 1 which delimits the tool arrangement 1 relative to a surroundings 8 of the tool arrangement 1. The housing 6 surrounds an interior 7 of the tool arrangement 1 is hermetically locked and/or lockable from the surroundings 8 by the housing 6. In particular, the arrangement 1 is locked and/or lockable relative to the surroundings 8 by the housing 6 in an airtight manner. The tool arrangement 1 includes a protective gas device, which is formed for example by the housing 6. Because of this, a protective gas atmosphere is present in the interior 7 with closed housing 6 to avoid scaling of the blank 4 during the transport between a tempering station 13 and a hot forming station 14, which are arranged in the interior 7.

The housing 6 includes a first lock 9*a* and a second lock 9*b*, by way of which the tool arrangement 1 can be opened. The hot forming steel strip 3 is introduced into the tool arrangement 1 through the first lock 9*a*. Through the second lock 9*b*, the hot formed component 6 (FIG. 2) is output from the tool arrangement 1.

The tool arrangement 1 includes a provisioning station 10, a cutting station 11, optionally a cold forming station 12, the tempering station 13 and the hot forming station 14. The hot forming station 14 includes a hardening device 14*a* and optionally a separating device 14*b*.

On the provisioning station 10, the hot forming steel strip 3 (FIG. 2) is provided in the form of a roll, in particular in the form of a so-called coil. The cutting station 11 cuts the blank 4 (FIG. 2) out of the hot forming steel strip 3. The blank 4 is formed, for example trimmed, stamped and/or bent on the cold forming station 12.

In the tempering station 13, the blank 4 is tempered, in particular heated in sections or completely. To this end, the tempering station 13 includes an inductive, resistive or conductive operating heat source. In particular, the blank 4 is tempered, in particular heated in the tempering station 13 in sections or completely to at least 400 degrees Celsius, in particular to at least 700 degrees Celsius, specifically to at least 900 degrees Celsius and/or to 1,000 degrees Celsius.

Figure 3:
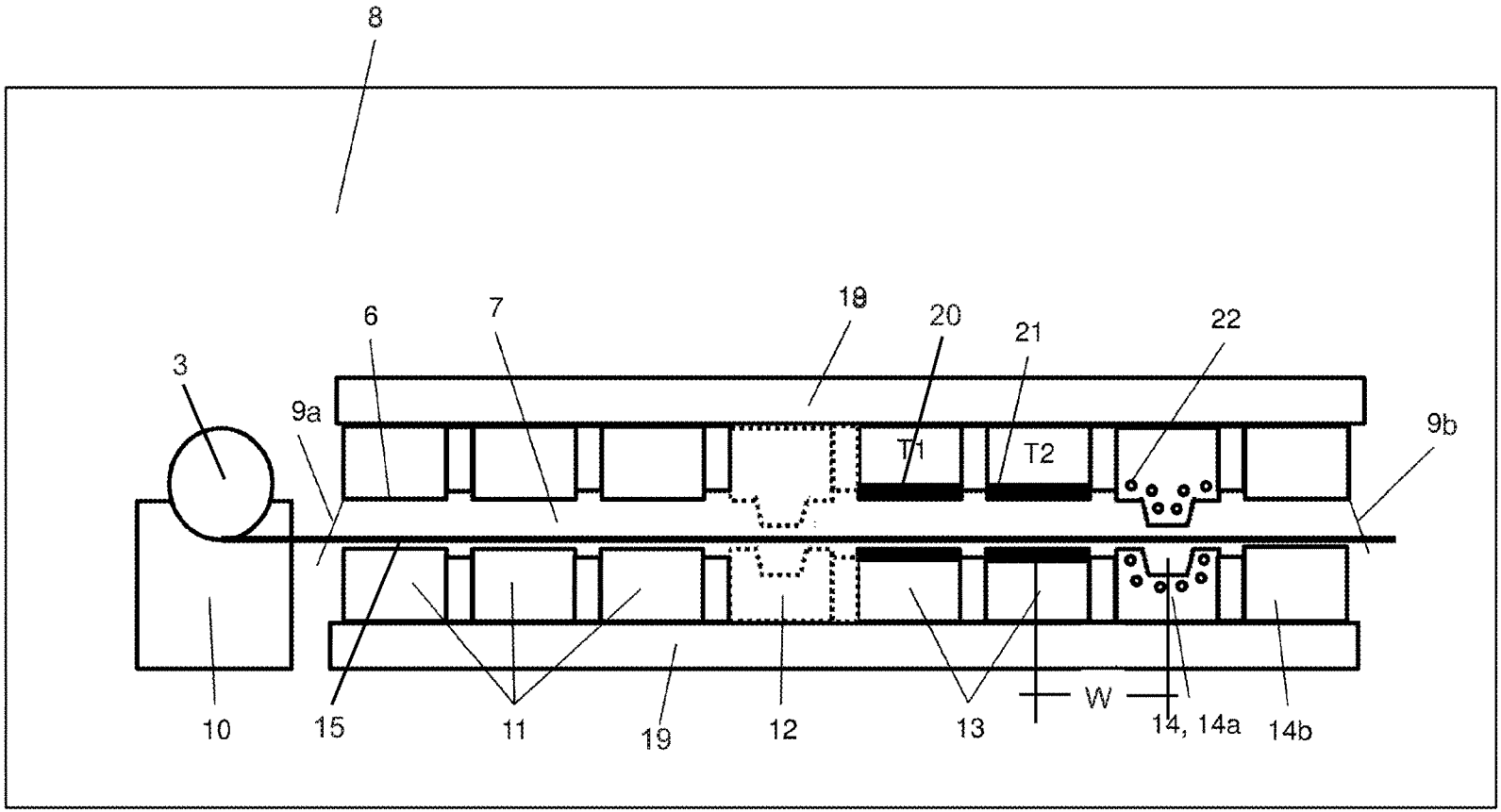
FIG. 3 is a longitudinal section through a modified tool arrangement in an overall representation as a progressive tool, wherein the production stations are arranged within the progressive tool.

In the case of tempering the blank 4 in sections, at least one first section 4*a* (FIG. 2) in the blank 4 is heated to a first temperature and at least one second section 4*b* (FIG. 2) of the blank 4 to a second temperature, wherein both temperatures deviate from one another. To this end, the tempering station 13 includes for example a first and a second temperature control element 20, 21 (FIG. 3). Because of this, different structures and/or crystal states are formed in the steel alloy of the blank 4 in the first and second section 4*a*, 4*b*. In the subsequent hot formed component 5, sections of different hardness are thus formed. It is also possible that the tempering station 13 includes a cooling device 20, 21 as the first or second temperature control element, which cools one of the sections 4*a*, 4*b* whereas the other section is heated.

The hot forming station 14 is configured to example as a hot forming press. It forms the tempered blank 4 into the hot formed component 5, for example in a deep-drawing operation. It is particularly important that the blank 4 has the temperature that is suitable for the hot forming. Because of the hermetic locking of the interior 7 of the tool arrangement 1 by way of the housing 6, a heat loss during the transport of the blank 4 from the tempering station 13 to the hot forming station 14 can be significantly reduced. This is advantageous in particular for thin blanks 4 for example with a thickness of less than 1.0 mm, since these cool more rapidly than blanks 4 with a greater thickness.

By way of the hardening device 14*a* integrated in the hot forming station, the hot formed component 5 is hardened by way of cooling. To this end, the hardening device 14*a* includes a cooling device 22 (FIG. 3). The separating device 14*b* separates the blanks 4 from at least one blank connection 17, via which the blank 4 is connected to at least one transport device 14, in particular when the transport device 15 is formed by the hot forming steel strip 3.

The aforementioned stations 10, 11, 12, 13, 14 are connected one behind the other and/or arranged in a row. Here, the provisioning unit 10 is arranged outside the interior 7 and the other stations 11, 12, 13, 14, 14*a*, 14*b* in the interior 7 of the tool arrangement 1. The hot forming steel strip 3 provided in the provisioning station 10, 11, 12, 13, 14 is conducted through the first lock 9*a* to the cutting station 11. To this end, the stations 10, 11, 12, 13, 14 are connected to one another by the at least one transport device 15 (FIG. 2) of the tool arrangement 1. Because of this, the blank 4 can be transported from the provisioning station 10 to the cutting station 11 via the cold forming station 12 and the tempering station 13 as far as to the hot forming station 14. The transport paths covered by the transport device 15 between the respective stations 10, 11, 12, 13, 14 are designed as short as possible to shorten a cycle time of the tool arrangement 1 and thereby save costs.

The transport device 15 can be formed by a conventional conveyor belt or chain belt. FIG. 2 shows the transport device 15 as a transport belt formed by the hot forming steel strip 3. The hot forming steel strip 3 is introduced from the provisioning station 10 as pre-blank 3*a* into the cutting station 11 for trimming and for forming the blank 4. The individual blanks 4 are arranged on the transport belt 15 spaced from one another by a gap 23. At its edges 16, the blank 4 is optionally connected to the transport belt formed by the hot forming steel strip 3 via at least one blank connection 17. Optionally, the hot forming station 14 includes a separating device 14*b* for separating the hot formed component 5 formed from the blank 4 from the blank connection 17.

FIG. 2 shows the production line 2 with the hot forming steel strip 3, the blank 4 and the hot formed component 5. The production line 2 includes, as shown in FIG. 1, the tool arrangement 1 with the aforementioned stations 10, 11, 12, 13, 14, 14*a*, 14*b* and the transport device 15.

The hot forming steel strip 3 is provided and unwound as roll or so-called coil on the provisioning station 10. An open end and the pre-blanks 3*a* of the hot forming steel strip 3 following thereon is transported into the cutting station 11 where it is cut into the blank 4.

If the optional cold forming station 12 is present, the blank 4 is transported to the same by the transport device 15. There, the blank 4 is cold-formed, for example trimmed, stamped and/or bent.

By way of the transport device 15, the blank 4 is transported further to the tempering station 13. In the tempering station 13, the blank 4 is tempered, in particular heated to a temperature or in sections to multiple different temperatures to make possible the subsequent hot forming of the blank 4.

A heating of the blank 4 by sections is shown in FIG. 1, in the case of which the first section 4*a* of the blank 4 has a temperature other than that of the second section 4*b* of the blank 4. The tempering station 13 includes at least one first heat transfer region which heats the first section 4*a* in that the first heat transfer region contacts the firsts section 4*a* for example completely and because of this completely transfers the heat energy that is available in this region to the blank 4. For heating the second section 4*b* to the other temperature, the tempering station 13 includes at least one heat transfer region that is insulated and/or arranged spaced from the second section, so that the originally available heat energy in this region is not completely transferred to the blank 4. Once the blank 4 has been heated by sections or completely, the transport device 15 directly transports the blank 4 to the hot forming station 14.

The transport path W between the tempering station 13 and the hot forming station 14 has a length which maximally corresponds to twice a width, preferably maximally 1.5 times a width and in particular to a maximum width of the blank 4. The width B of the blank 4 extends in throughput direction R, when the blank 4 is transported on the transport device 15. If the transport device 15 has been created as a transport belt formed by the hot forming steel strip 3, the transport path W is preferably obtained from the blank width B and the gap 23. It is advantageous, in particular, that the transport path W between tempering station 13 and the hot forming station 14 is reduced since thereby cooling of the blank 4 during the transport can be restricted and because of this up to 30% of the energy costs for the tool arrangement 1 can be saved.

The tempered blank 4 is formed in the hot forming station 14 into the hot formed component 5, in particular deep-drawn and/or pressed. Following this, the hot formed component 5 is hardened in the hardening device 14*a* of the hot forming station 14 in that it is greatly cooled down there. The blank connection 17 is separated in the separating station 14*b*. Following this, the hardened and/or cooled hot formed component 5 is output from the hot forming station 14 and from the tool arrangement 1 by way of the lock 9.

When the hot forming station 14 is charged with the tempered blank 4, the same has a first component temperature. When the hot formed component 5 produced from the blank 4 is output from the hot forming station 14, the same has a second component temperature. The same corresponds to or approximately equals an ambient temperature of the surroundings 8. In particular, the second component temperature is elevated maximally by 50%, preferably by maximally 35%, specifically by maximally 20% relative to the first component temperature. Because of the component temperature adapted to the ambient temperature, handling of the hot formed component 5 following the output from the tool arrangement 1 can be accomplished easily and safely. Furthermore, the ambient temperature is not undesirably heated through the output of the hot formed components 5 from the tool arrangement 1.

FIG. 3 shows a longitudinal section through the tool arrangement 1 as a further exemplary embodiment of the present disclosure. The tool arrangement 1 is designed as a progressive tool. The tool arrangement 1 includes an upper tool 18 and a lower tool 19. Together with the locks 9*a*, 9*b*, the upper tool 18 and the lower tool 19 include the interior 7. The housing 6 is formed towards the top and towards the bottom in particular by the upper tool 18 and by the lower tool 19. At the face ends, the first and second lock 9*a*, 9*b* form the bulkhead. Optionally complementary, longitudinal sides of the tool arrangement 1 are sealed off by way of offsetting elements, in particular when the longitudinal sides are exposed by the tool stroke.

The interior 7 is sealed off air-tight, in particular hermetically relative to the surroundings 8. The provisioning station 10 is arranged in the surroundings 8 outside the interior 7. All remaining stations 11, 12 (optional), 13, 14, 14*a*, 14*b* are arranged in the interior 7. The first lock 9*a*, by way of which the hot forming steel strip 3 is initially introduced into the cutting station 11 influence the air-tight sealing and if applicable the protective gas atmosphere in the interior 7.

The tempering station 13 according to FIG. 3 is divided into two stages to obtain the tempering time of two cycles.

However, embodiment with one stage and more than two stages is also possible. In the first stage shown in FIG. 3, the tempering station 13 includes the first temperature control element 20 for pre-tempering the blank 4 or regions thereof. In the second stage, the tempering station 13 includes the second temperature control element 21 for tempering the blank 4 or regions thereof to the required end temperature. The hot forming station 14 and the hardening station 14*a* are accommodated in one stage.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A progressive tool arrangement for integration in a production line to produce a hot formed component from a blank, which is produced from a hot forming steel strip, the progressive tool arrangement comprising:

a housing that surrounds an interior of the progressive tool arrangement, the housing including a first lock at a first end and a second lock at a second end, the first lock and the second lock configured to lock to seal the housing relative to a surroundings of the progressive tool arrangement, the first lock configured to unlock to open the housing to receive the hot forming steel strip and the second lock configured to unlock to open the housing to remove the hot formed component;

a tempering station positioned within the housing for tempering the blank; and a hot forming station positioned within the housing for hot forming the blank;

wherein the tempering station and the hot forming station are jointly arranged in the interior of the housing.

2. The tool arrangement according to claim 1, wherein the housing shields the progressive tool arrangement relative to the surroundings in an air-tight manner.

3. The tool arrangement according to claim 2, further comprising a protective gas device for generating a protective gas atmosphere in the housing.

4. The tool arrangement according to claim 1, further comprising a transport device connecting the tempering station and the hot forming station for transporting the blank, wherein a transport path between the tempering station and the hot forming station covered by the transport device is exclusively arranged in the housing.

5. The tool arrangement according to claim 4, further comprising a transport belt for transporting the hot forming steel strip, wherein the blank produced from the hot forming steel strip is arranged spaced from a further blank by a gap and is transported on the transport belt.

6. The progressive tool arrangement according to claim 1, wherein the hot forming station comprises a hardening device for hardening the blank formed into the hot formed component.

7. The progressive tool arrangement according to claim 1, wherein the tempering station comprises a heat source which is configured as one of an inductive heat source, a resistive heat source or a conductive heat source.

8. The progressive tool arrangement according to claim 1, wherein the tempering station includes a plurality of regions and each region is configured to temper the blank by sections.

9. The progressive tool arrangement according to claim 1, wherein the tempering station has a single region that is configured to temper the blank completely.

10. The progressive tool arrangement according to claim 1, wherein the progressive tool arrangement further comprises a cutting station for cutting the blank out of the hot forming steel strip, wherein the cutting station is arranged in the interior of the progressive tool arrangement.

11. The progressive tool arrangement according to claim 1, wherein the progressive tool arrangement further comprises a cold forming station for cold forming and/or trimming the blank, wherein the cold forming station is arranged in the housing of the progressive tool arrangement.

12. A production line comprising:

a progressive tool arrangement to produce a hot formed component from a blank, which is produced from a hot forming steel strip, the progressive tool arrangement including:

a housing that surrounds an interior of the progressive tool arrangement, the housing including a first lock at a first end and a second lock at a second end, the first lock and the second lock configured to lock to seal the housing relative to a surroundings of the progressive tool arrangement, the first lock configured to unlock to open the housing to receive the hot forming steel strip and the second lock configured to unlock to open the housing to remove the hot formed component a tempering station positioned within the housing for tempering the blank; and a hot forming station positioned within the housing for hot forming the blank;

the blank, the blank having a width, wherein the tempering station and the hot forming station are jointly arranged in the interior of the housing and a transport path between the tempering station and the hot forming station has a length is less than or equal to the width of the blank and a width of the gap.

13. The production line according to claim 12, wherein the production line further comprises the hot formed component, wherein the hot formed component is produced from the blank, wherein the blank has a charging state when the tempering station is charged with the blank and wherein the blank has an output state when the blank is output as the hot formed component from the hot forming station, wherein the blank in the charging state has a first component temperature which corresponds to an ambient temperature of the progressive tool arrangement and wherein the blank as the hot formed component in the output state has a second component temperature, wherein the second component temperature is elevated relative to the first component temperature by no more than 50%.

14. The production line according to claim 12, wherein the production line comprises the hot forming steel strip.

* * * * *